US006257473B1

(12) United States Patent
Ringelstetter

(10) Patent No.: US 6,257,473 B1
(45) Date of Patent: Jul. 10, 2001

(54) SANITARY COLLECTION HOLDER FOR ANIMAL WASTE

(76) Inventor: Nicholas Clement Ringelstetter, E9919A Second St., PrairieDuSac, WI (US) 53578

( * ) Notice: Subject to any disclaimer, the term of this patent is extended or adjusted under 35 U.S.C. 154(b) by 0 days.

(21) Appl. No.: 09/282,005

(22) Filed: Mar. 29, 1999

(51) Int. Cl.[7] ..... A45F 1/04

(52) U.S. Cl. ..... 224/675; 224/148.5; 224/245; 224/575; 224/584; 224/681; 224/682; 119/795; 383/38; 383/40; 190/109

(58) Field of Search ..... 224/148.1, 148.5, 224/148.6, 148.7, 245, 575, 660–665, 584, 191, 674, 675, 676, 677, 680, 681, 682, 684; 383/38, 40; 119/795; 190/109, 111

(56) References Cited

U.S. PATENT DOCUMENTS

| | | | | |
|---|---|---|---|---|
| D. 393,504 | * | 4/1998 | Eisman | 383/40 X |
| 784,914 | * | 3/1905 | Boyle | 224/148.5 X |
| 1,605,195 | * | 11/1926 | Lewis | 224/677 X |
| 2,761,481 | * | 9/1956 | Boatwright | 383/40 X |
| 4,974,762 | * | 12/1990 | Boretsky et al. | 224/148.5 |
| 5,024,361 | * | 6/1991 | Flowers | 224/245 X |
| 5,265,719 | * | 11/1993 | Wand | 190/109 X |
| 5,388,740 | * | 2/1995 | Barland | 224/675 |
| 5,447,227 | * | 9/1995 | Koseberg | 206/233 |
| 5,713,616 | * | 2/1998 | Knudson | 294/1.3 |
| 5,718,192 | * | 2/1998 | Sebastian | 119/795 |
| 5,727,500 | * | 3/1998 | Conboy | 119/795 X |
| 5,890,637 | * | 4/1999 | Furneaux | 224/191 |

* cited by examiner

*Primary Examiner*—Gregory M. Vidovich
(74) *Attorney, Agent, or Firm*—Sidney N. Fox

(57) ABSTRACT

A sanitary pet-waste collection pouch including an interior open-topped chamber for holding tied loaded plastic bags containing retrieved pet-waste, the pouch having a flap portion carrying interior and exterior opening pockets on opposite sides thereof, a pair of deep side-pockets on opposite sides of the chamber, releasable retaining loops coupled to the respective deep side-pockets, the interior opening pocket carrying a supply of plastic litter bags and the exterior opening pocket carrying personal effects, releasable retainer loops coupled to the deep side-pockets and each formed of a strip carrying opposite sided "hook" and "pile" portions which are engaged to form the loop, "hook" and "pile" portions being self-engagable forming the loops, and pockets on opposite sides thereof. The flap portion carries a horizontal "hook" portion and is fitted over the open interior chamber and engages a "pile" portion applied to the outer wall of the pouch at a location angular to the "hook" portion, the engagement being adjustable at any location along the length of said "pile" portion dependent upon the girth of the pouch.

22 Claims, 3 Drawing Sheets

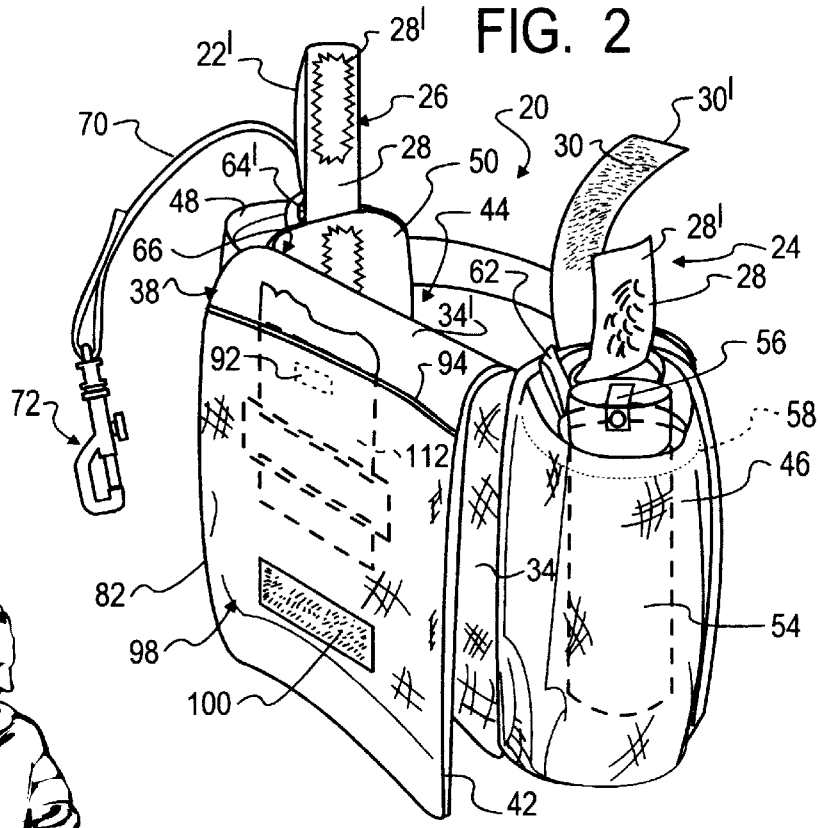
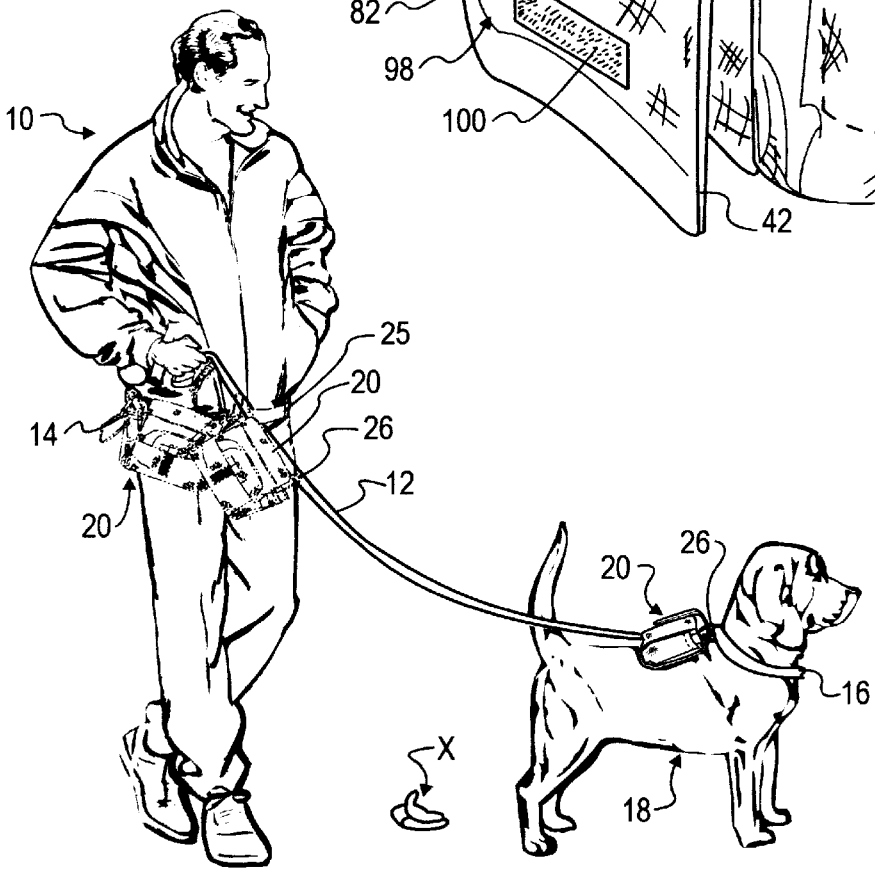
FIG. 1

SANITARY COLLECTION HOLDER FOR ANIMAL WASTE

FIELD OF THE INVENTION

This invention relates generally to animal waste collection and more particularly provides an improved sanitary animal waste collection pouch which is compartmentalized expandable, adjustably closable and capable of being carried either by the pet owner, the pet leash or by the pet.

BACKGROUND OF THE INVENTION

The art is replete with apparatus for retrieving and collecting animal waste, particularly fecal matter, deposited by a domestic animal traveling with its owner along the public way, i.e. sidewalks, park trails, public and private lawns, school-yards and public and private urban areas. Many cities and municipalities have enacted laws requiring domestic animal owners to restrain their pet animals particularly dogs, by having them attached to a leash, and, as well, to retrieve their fecal deposits. The pet owner is required to "cleanup" after their dogs so as to prevent others from stepping in or on the waste, and to inhibit the health risk associated with its presence.

In the past, these laws were seldom observed, such laws being difficult to enforce. However, recently, enforcement of these laws have increased with fines and public ridicule becoming common penalties for failure on the part or pet owners to observe such public nuisance abating laws. Public campaigns have become commonplace to alert and to force pet pet owners to pickup such fecal deposits left by domestic dogs.

The prior art has provided an array of apparatus for use in aiding pet owners with the odious and generally unpleasant task involved in collecting dog feces left by their pets. So called "pooper-scoopers", a newspaper, tissue and plastic litter bags have become a plastic litter bags have become a necessary accompaniment to the dog owner walking his or her dog. Not only are the tasks difficult, odious, etc., the apparatus available for such use often are ungainly to carry and to use.

Some of these devices provide containers having detachable lids so that the feces deposit is scooped manually from the site of deposit and placed in the container. The lids of such container are reattached to such container. These containers often are too bulky to carry while walking the dog.

In picking up after their dogs, not only have the dog owners experienced direct "hands-on" risk of getting the excrement on his or her hands when scooping up the deposit from its location and/or transporting and delivering the retrieved deposit to a sanitary depository facility. Further, the implements used to retrieve the deposit as well as well as the container for such deposit are not easily cleaned after use. In addition, carrying the retrieved deposit until a suitable depositary facility is reached, such as a refuse or garbage container or the like, is reached, can be a serious problem. Further, pet owners often must carry a box carrying a supply of fresh plastic bags from which to select one fresh bag to lift the fecal deposit from its site of deposit and tie or otherwise secure the bag leakage or breaking, in the course of such steps, getting their person or belongings soiled.

Pet owners have been forced to carry along a newspaper from which to tear off a portion for retrieving the fecal deposit and carry the deposit wrap in such a paper portion a garbage or other refuse container, occasionally an open container, occasionally an open wire paper refuse container, which may be some distance from the site of the pickup. As can be anticipated, notwithstanding nuisance abating statutes and the health risk associated with the presence of such fecal deposits, leaving dog excrement deposits unattended in public parks and other urban areas still remain prevalent.

Under present municipal statutes, the pet owner couples a dog to a leash when exercising the dog for example, walking the dog along the public way or through a park, for example. Often, the dog owner takes his or her dog for a walk along a street or in a park to fulfill his obligation to enable the dog to exercise, as well as to perform its eliminatory duty exterior of the dog's living quarters. Often, on these occasions, the dog owner takes his or her dog for a walk along a street or park to fulfill his obligation to enable the dog to exercise as well as to perform its eliminatory duty exterior of the dog's living quarters. Often, on these occasions, the dog owner remembers, only long after the walk has started, that he or she failed to take along any convenient means required to clean up any deposit made by the dog in the course of its out-of-door exercise. Such even creates an unwelcome problem for the dog owner. Compliance with legal standards require the dog owner to return to his start location, pickup the necessary litter bags, tissues, etc., and return to the place of the dog's deposit. There a need to provide a convenient "take-along" package containing disposal litter bags, pads, waste collecting means, etc., and, as well, waste storage means to collect and temporarily store the retrieved dog waste until an adequate disposal station is reached. Thus, the fecal deposit may be required to be carried through the remainder of the outing, generally within the disposal litter bag used to pickup the deposit.

The prior art has suggested an array of apparatus for aiding pet owners with the unpleasant task of collecting the feces deposit(s) left behind by their pets but these are difficult to carry and not easily employed without risking getting the fecal material on his or her hands or apparel. One prior art device incorporates a collapsible frame operative for supporting a bag in open condition and further includes a paddle or like means to engage the deposit and transfer the deposit into the bag. However, although such paddle must be cleaned immediately after transfer, there is usually no provision for the cleaning task on site, since means for effecting the cleaning task often do not accompany the device. If a cleaning cloth is present, it must be carried by the pet owner and discarded with the fecal material not removed therefrom. One major factor that discourages the pet owner from picking up after the pet is the fear of getting his or her hands dirty in the course of such activity and in the absence of any convenient means means for performing such act.

There are kit-type animal waste collection means including a box having a plurality of contents for aiding a user in collecting and disposing of the pet excrement. Such contents include an absorbent material, a disinfectant, a scoop for picking up the deposit and a scraper for scraping the fecal matter from the surface upon which the fecal material is deposited, a supply of plastic litter bags for containing the retrieved fecal deposit and, of course, a compartment for receiving the fecal-loaded plastic bags. Cleaning and storing of the scoop and/or the absorbent bags. Cleaning and storing of the scoop and/or the material still remains a material problem. Such kits are somewhat heavy and cumbersome to carry, use and transport. Use of such kits also require gloves, towels, handiwipes and the like to be stored and periodically replaced, increasing the cost of the kit.

Where provided, use of a paddle may not be efficient for picking up the deposit or guiding the deposit into the plastic or paper bag in challenging deposits made in irregular terrain or deep grass, for example. This can be frustrating to the pet owner, occasionally causing the user to simply leave the deposit site without picking up the deposit. There remains an absence of carrier means which provide for efficient transport and storage of the fecal matter to a disposal facility subsequent to collection thereof. Another problem for which an adequate solution is not provided involves the prevention of leakage from waste collecting means or temporary holder into which the retrieved fecal matter is deposited on-site.

Of the prior patented art dealing with the problem concerned here, several patents of interest have been considered as indicating the state of the art as to efforts to facilitate handling of the collection of pet waste by pet owners. Among these are:

| Patentee | U.S. Pat. No. | Date |
|---|---|---|
| Hess | 5,560,321 | 10-01-96 |
| Roe | 5,363,809 | 11-15-94 |
| Nevitt | 5,184,762 | 02-09-93 |
| Lindsey | 5,233,942 | 08-10-93 |
| Conboy | 5,727,500 | 03-17-98 |
| Knudsen | 5,713,616 | 02-03-98 |

The Hess patent discloses a pouch-like dog waste carrier and plastic bag dispenser arrangement comprising a pair of pockets on either side of a dog harness to be worn by the dog. One pocket carries a dispenser box holding plural folded plastic litter bags. The dispenser box and one pocket have matching slots through which the litter bags can be dispensed one at a time. The other pocket, absent the slot, is employed to hold "loaded" plastic litter bags tied, closed and introduced therein. The pocket intended to carry the "loaded" plastic bags has a flap which is secured, via a "hook and pile" Velcro combination closure on the flap and the exterior body of said pocket. ("Velcro" is a trademark of Velcro International Inc.). There are no additional pockets for carrying items other than the empty liter bags and waste-filled litter bags. Rather than being conveniently secured to the animal's collar, the unit would have to be fitted onto the harness worn by the animal for each excursion, walk, etc.

The Roe patent provides a carrier comprising a pair of open-ended pouches formed by a hollow sheath bound mid-length in the form of a "bow-tie" by a band or knot to create a pair of the opposite open-ended pockets. At least one of the pockets can be sealed with "hook and pile" fastening means to close off the open ends thereof. The "Velcro" closure or closures are inner positioned for sealing purposes. A self-locking plastic strap is interfaced with the "bow-tie" knot and can be secured to the animal's collar or to a leash. The Roe carrier, when worn by the animal, soon would become unbalanced and difficult for the animal to wear. There is some question as to the capacity of the Roe holders and the ability of the holder to retain the feces in the feces-loaded litter bags even when the open top of the holder is secured together but not sealed about its opening.

Lindsey describes a cylindrical container into which is inserted a roll of plastic bags, which may be selected from conventional sandwich bags, storage bags, kitchen bags and the like, which are provided in a continuous roll and inserted through the open-end of the container. The container has a longitudinal slot through which the bags are serially dispensed one at a time. The exterior of the cylindrical container has a loop to which the handle end of a leash can be attached. The other end of the leash has a coupling device for attachment to the animal's collar. The unit is not provided with means to store "loaded" bags but provision is made to carry or attach a "pooper-scooper" and/or a hand-grip to the container.

Nevitt also provides a harness secured to the animal. The harness has a strap to which are attached sever holders for carrying containers such as cylindrical beverage containers and also includes a loop attachable to a leash. This unit does not dispense or carry litter bags, whether loaded or empty. This patent is similar to Hess in that a harness is provided which carries containers, but Nevitt carries only beverage cans rather than containers respectivelyly intended to carry fresh litter bags and loaded fecal waste bags reactively.

Conboy describes a leash-mounted storage device which provides front and rear pouches attached together defining a channel to accommodate the passage of a leash. The leash is passed through the channel between the front and rear pouches. Both the front and the rear pouches are foldable for transport. The front pouch has a longitudinal overlapping opening for receiving a supply of disposable litter bags, and has an open top provided with a "hook and pile" Velcro-type closure at the interior of the mouth of the open top. The rear pouch is attached to the back of the front pouch to define the channel. A pair of "hook and pile" fastening straps are secured to the back of the front pouch at spaced positions. One of the fastening straps is passed through the hand-loop of the leash while the other of the fastening straps is wrapped around an intermediate length of the leash to secured the storage portion at a fixed position along the leash.

In Conboy, the front pouch has a top opening but remains folded until used. The front pouch receives the waste-loaded closed end and tied litter bags when the pouch is unfolded. The "hook and pile" Velcro-type closure is positioned at the lower exterior closed end of the front pouch to support the front pouch in folded condition. The storage device can be used for holding useful pet-related items such as pet-toys, pet-medication, water container, etc., when not used for carrying the waste-loaded litter bags. However, there is no provision for carrying any of these items in either of the front or rear pouches if one or the other or both are used to carry waste-loaded litter bags. The Conboy storage device must be hand-carried by the hand loop of the leash and cannot be carried by the animal.

Knudsen provides a purse-like receptacle having a chamber for receiving loaded plastic bags. This chamber has a closure flap which includes a pocket for containingunused plastic litter bags, at least a par of foldable pleated side walls. The flap pocket is closed by a zipper. Likewise, a zipper is provided in at least one of the side walls for establishing selective access to one of the front pockets. The zipper in the side wall can extend around the bottom of the chamber for cleaning, if necessary. Rings are attached by loops formed of canvas or are secured to the receptacle. A belt can be threaded through the rings for easy transport of the receptacle.

The pocket in Knudsen for containing the plastic waste collection bags is accessible by manipulating a zipper. The fill interior is lined with an absorbent material. Knudsen also secures the hook strip of "hook and pile" Velcro-type fastener to the interior of the chamber for cleaning, if necessary. Rings are attached by loops formed of canvas or are secured to the receptacle. A belt can be threaded through the rings for easy transport of the receptacle. Knudsen also secures the hook strip of a "hook and pile" Velcro-type fastener to the interior facing portion of the flap across the lead end of the flap along the lead end of the flap along the longitudinal seam thereof and the pile strip of a "hook and pile" "Velcro-type" fastener across the central portion of the outer front surface of the receptacle to close the receptacle chamber when the flap is brought over the opening to the chamber and the "hook" strip engaged with the "pile" strip of the "hook and pile" Velcro-type closure. A pair of front pockets are formed in the front of the receptacle opening across the front thereof to receive a scoop paddle while the second pocket is intended to receive a portion of a collapsible frame or other tools. The interior facing flap pocket opens along the side of the flap interior thereof. A zipper is installed along each side of the receptacle to permit full opening of the receptacle (chamber and flap) to access the interior lining of the receptacle and flap. The collapsible frame is used, after being erected, to hold the bag open for introducing excrement therein using the scoop paddle. A conventional waterproofing material is sprayed on the interior lining of the flap and interior chamber to facilitate cleaning of the fully opened interior lining.

The Knudsen unit must be carried by the pet owner by a "shoulder-strap" and cannot be carried by or worn by the pet. There remains a problem of cleaning the interior of the chamber, particularly if the pet waste is placed directly into the interior of the chamber. The opening of the flap pocket along the side of the flap exposes the interior of the pocket and the contents thereof to excrement introduced to the interior of the chamber, particularly when the feces is introduced directly when the paddle scoop is employed. Thus, many of the unmet needs of the earlier discussed prior art reman with the Knudsen proposed unit.

Accordingly, there remains a need for a convenient, relatively small-sized, purse-like carrier for collecting and holding the animal fecal deposit left on the ground surface, for example, the animal's exercise in the course of being taken for a walk by the pet owner.

Of considerable importance in any proposed solution to a pet-waste collection pouch carrier is the capability of said carrier to offer reasonable security against leakage of the excrement in the course of retrieving the fecal deposit, introducing the deposit into the holding chamber or retaining the recovered excrement deposit within the collection pouch carrier. This lack of security has been a problem in most of the available prior art waste-collection carrier pouches since the closures often leave path-ways for leakage after the conventional plastic bag has been transferred to the carrier pouch and the carrier pouch closed, either by inadequate closures over the entrance to the chamber holding the loaded bags or by presence of small chambers resulting from folding of the portions of the unit.

The desired carrier is expected to provided features not found in the typical carriers provided by the prior art. The desired carrier would be a unitary purse-like pouch provided with a closure flap, the exterior and the interior of which includes pockets not only for holding and dispensing plural plastic litter bags, singly if desired, but one or more of the pockets for receiving and retaining such personal effects of the pet owner such as identification cards, driver license, credit cards, money and other relatively flat materials. It also would be desirable if the carrier provides easily accessible means for carrying a hand sanitizer dispenser enabling the user to clean and sanitize his or her hands subsequent to picking up the pet deposit. Desirably, the carrier also would provide means also to carry, conveniently, such items such as keys, pens, pencils, a small light or the like. It would be advantageous if the sanitary waste carrier unit would be small enough to be easily carried by the pet owner or worn by the animal as, for example, being secured to the collar of the animal yet retaining the waste collected while the animal is exercised by walking along with the pet owner.

It would also be advantageous if the contents of the outer and interior pockets can be easily accessed, and, also, if the dispensing hand sanitizing fluid container can be easily accessed and operated without separation from the carrier. The exterior appearance of the hand sanitary carrier of the invention should be attractive, resembling a hand held purse with a grained outer surface and a smooth interior surface to enable cleaning thereof.

BRIEF SUMMARY OF THE INVENTION

The invention provides sanitary pet-waste collection pouch for the collection and temporary storage of animal waste, said pouch including an interior open-topped chamber for holding tied and sealed plastic litter bags loaded with pet-waste, and a cover flap having interior opening and exterior opening pockets. The sanitary pet-waste collection pouch is formed of a nonabsorbent woven fabric material having opposite sides, one being smooth and the opposite side being grained. The smooth side comprising the interior surface of the sanitary pet-waste collection pouch and the grained side forming the exterior surface of said sanitary pet-waste collection pouch. Also provided are "hook and pile" retaining loops secured to the pouch. The exterior of the sanitary pet-waste collection pouch carries cooperative "hook and pile" closure means adjustably to close off the interior chamber even when the girth of the chamber is expanded variably due to the number of tied and sealed loaded pet-waste bags within the interior chamber expanding the girth of the sanitary pet-waste collection pouch. "Hook and pile" closure means are provided within each of the interior and exterior opening pockets. One of the interior and exterior opening pockets is capable of holding plural plastic litter bags while the other of the interior and exterior opening pockets is capable of receiving flat personal effects of the pet owner such as identification, driver's license, currency, etc.

The sanitary pet-waste collection pouch of the invention further provides deep-side pockets, at least one of which carries and retains a hand-sanitizer dispensing container and the other deep-side pocket is capable of receiving other longer personal items of the pet owner such as pens, pencils, screw driver and similar or other tools.

Preferably, the adjustable pouch closure means comprise "hook and pile" closures. The sanitary pet-waste collection pouch adjustable closure is formed of "hook" portion of a "hook and pile" strip secured horizontally across the cover flap adjacent the closed end of the cover flap while the exterior surface of the sanitary pet-waste collection pouch carries a longer "pile" portion of a "hook and pile" closure strip oriented at an angle across said exterior surface of the front wall of the pet-waste collection pouch, preferably perpendicular, to the orientation of the "hook" portion so that the cover flap may be folded over the open-topped interior chamber and secured to said exterior front wall surface adjustably with the "hook" portion engaged with the "pile" portion at any location along the "pile" portion so as to close the interior chamber and the sanitary pet-waste collection pouch regardless of the variability of the girth of said interior chamber and the sanitary collection pouch due to the number of the pet-waste loaded plastic bags therein which increase the girth of said sanitary pet-waste collection pouch.

BRIEF DESCRIPTION OF THE DRAWINGS

FIG. 1. is a perspective elevation showing a representative pet-owner shown engaged in walking his pet while carrying the sanitary pet-waste collection pouch embodying the invention FIG. 2 is a rear perspective elevation of the sanitary pet-waste collection pouch embodying the invention, illustrated in opened condition;

DESCRIPTION OF PREFERRED EMBODIMENT

Figure 4:
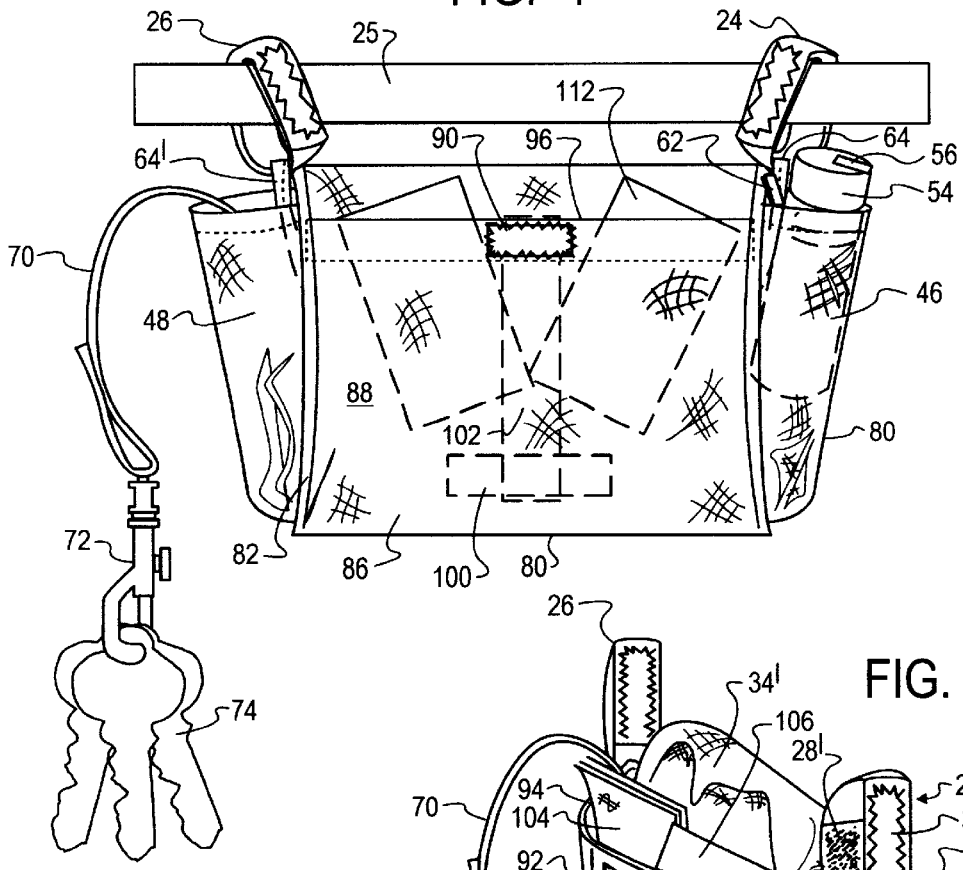
FIG. 4 is a front elevation of the sanitary pet-waste collection pouch embodying the invention illustrated in closed condition as carried on the belt worn by a person, such as the pet owner.

Referring to FIG. 1, there is illustrated an individual pet owner 10 shown engaged in the conventional "take a walk with his pet" (here a dog). The pet owner 10 is shown in the course of walking along a path, head in the air, one hand holding the leash 12 by its handle 14 while the opposite end of the leash 12 is coupled to the collar 16 worn by the pet, a dog 18. The sanitary pet-waste collection pouch 20 also can be hand held or can be carried on the belt of the pet owner.

The pet 18 is illustrated standing stationary, after having left its "deposit" X on the ground, with the sanitary pet-waste collection pouch 20 of the invention as attached to pet collar 16 by retaining loop 26 of the retaining loops 24,26 while the leash 12 is threaded through the retaining loop 24.

Alternately, the sanitary pet-waste collection pouch 20 can be carried by the handle 14 alone simply by opening the retaining loop 24, passing a portion of the disengaged retaining loop 24 through the handle 14 and re-engaging the retaining loop 24 (as shown in FIG. 1). The leash 12 is threaded through the other retaining loop 26 instead of being secured on the pet collar 16. This is advantageous for use of the said pet-waste collection pouch with a conventional retractable type leash (not shown).

The retaining loop 24 can be released from the handle 14 so as to be capable of riding with the retaining loop 26, along the length of the leash 12 toward the end thereof. The retaining loop 26 then can be coupled to the pet collar 16 or to the conventional ring (not shown). When this occurs, the pet 18 can carry the sanitary collection pouch 20 as shown in FIG. 1. In FIG. 1, two of the possible three carrying locations for the sanitary pet-waste collection pouch 20 are shown in phantom line representation.

As shown in FIGS. 2–6, retaining loops 24,26 extend outward of the opposite top sides of the sanitary pet-waste collection pouch 20. Each of the retaining loops 24,26 is formed of a respective "hook and pile" strip 22,22'. Each "hook and pile" strip 22,22' has the "hook" portion 28 thereof located on one side surface 28' thereof and the "pile" portion 30 located on the opposite side surface 30' thereof. The respective ships 22,22' are formed into the respective loops 24,26 by engaging their respective "hook" and "pile" portions. In FIG. 2, the retaining loop 24 is illustrated in the process of being formed with the retaining loop 24 opened before engagement of the separated portions 28,30.

Each of strips 22,22' and hence the retaining loops 24,26 formed thereby are secured to the sanitary pet-waste pouch 20 at opposite sides thereof as shown in FIGS. 2–6. One of the strips 22, 22', strip 22' for example, can be narrow, so that upon disengagement, the strip 22' could be passed through the conventional license ring (not shown) conventionally carried on dog's collar 16.

Figure 7:
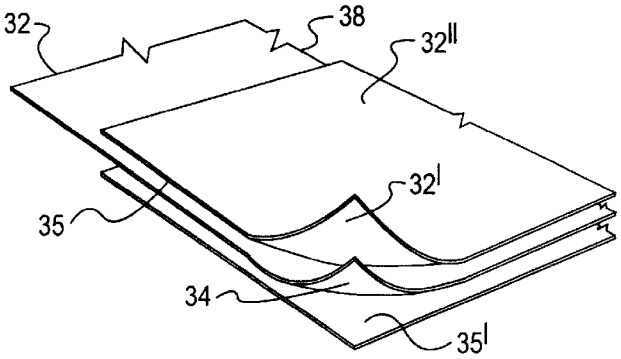

With reference to FIGS. 2 and 7, the sanitary pet-waste collection pouch 20 of the invention is illustrated in open condition and, referring specifically to FIG. 7, is formed, first, of a single elongate rectangular sheet 32 of nonabsorbent woven fabric material folded to form front and rear walls 34,36 respectively of the sanitary pet-waste collection pouch 20. Referring specifically to FIG. 7, preferably, the sheet 32 has one side 32' thereof having a smooth surface and the opposite side 32" thereof is provided with a course grained surface. (Nylon is a trademark of E. I. DuPont Corporation). The smooth surface of side 32' of the woven Nylon fabric sheet 32 forms the interior surface of the sanitary pet-waste collection pouch 20 while the coarse, grained surface of opposite side 32" of sheet 32 forms the exterior surface of the sanitary pet-waste collection pouch 20. The longitudinal edges 38 of the rectangular sheet 32 are folded over and sewn to form bound seam 42 therealong. The sheet forming the front wall 34 of the of the pouch 20 continues to form the bottom of the pouch 20 and the rear wall 36 thereof and further continues to form the cover flap 82 including the pocket 88 thereof. A portion 34' of sheet 32 overlapping the chamber 44 is linked to the rear wall 36 and continues to define the rear wall. When flap cover 82 a folded over the chamber 44 from its condition resting upon front wall 34 of the pouch 20, the front and rear walls 34,36 form the open-topped, open-sided chamber 44 whose sides are closed off by a pair of open-top elongate side-pockets 46,48 formed of the same nonabsorbent fabric material as walls 34 and 36. The chamber 44 has a generally U-shaped formation having the longitudinal edges thereof joined to an elongate bridging wall section 50. The bridging wall section 50 is formed of the same woven nonabsorbent fabric material as sheet 32 and is sewn to the longitudinal bound edge of said sheet 32 forming a leak proof seam 42 along the length of said deep-side pockets 46,48, the longitudinal edges of the front and rear walls 34,36 being included in said seam 42 whereby to close off the otherwise open sides of the chamber 44.

The deep side-pocket 46 is capable of receiving a hand-sanitizer container 54 provided with a flip-open dispensing spout 56. The hand-sanitizer compositions are commercially available and may constitute a liquid, a cream or a gel.

Figure 5:
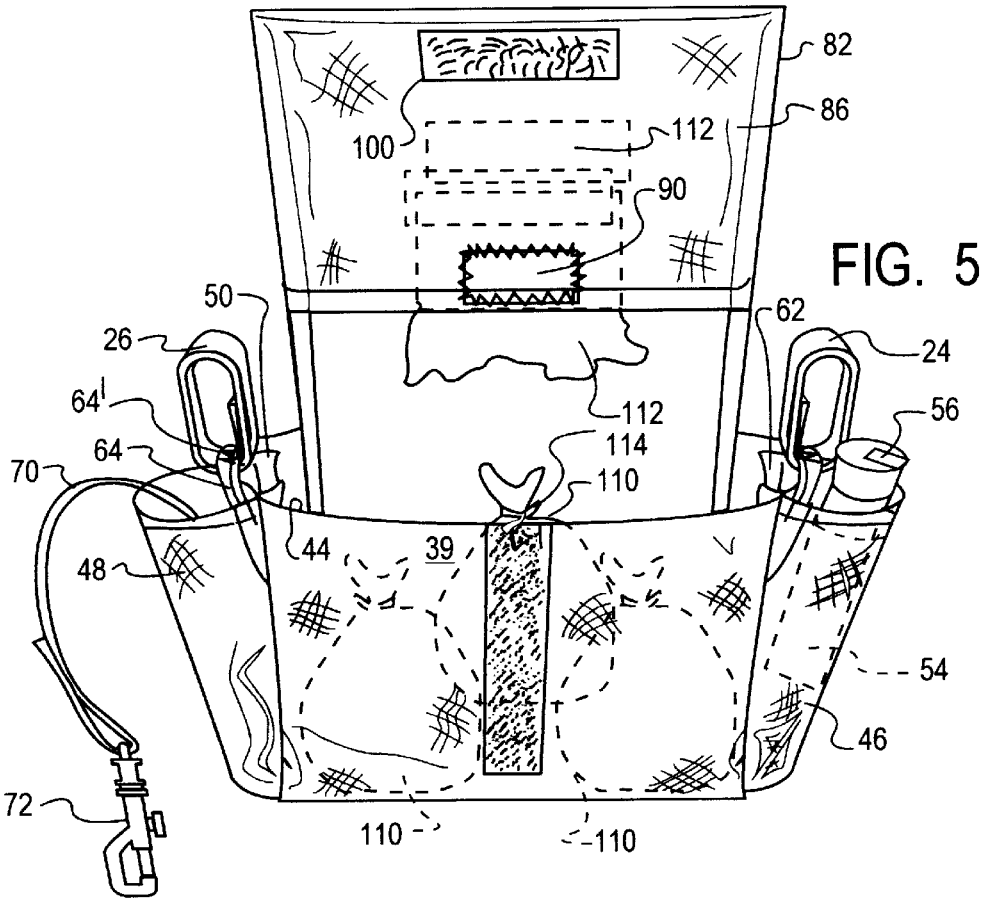
FIG. 5 is a front elevation of the sanitary pet-waste collection pouch embodying the invention shown in fully open condition, said pouch illustrated filled with waste-loaded and tied plastic litter bags disposed within the interior chamber of said pouch.

An elastic restraining band 58 is secured to the interior of the deep side-pocket 46 adjacent the open upper end 60 of said deep side-pocket 46 and is of a length sufficient to enable the elastic restraining band 58 to retain the hand-sanitizer container 54 within deep side-pocket 46. The opposite ends of the elastic restraining band 58 are sewn to the interior of the deep side-pocket 46 so that the elastic band 58 extends across the interior thereof. The mid-portion of the band 58 is doubled and sewn together spaced from the opposite ends thereof, defining a purchase end 62 free to enable the user to grasp it and pull the elastic band 58 for accessing the hand-sanitizer container 54. Reference is directed to FIGS. 2 and 5 to provide an illustration of said elastic restraining band 58. Each strap 64,64' has opposite ends thereof secured to the interior wall 66 of each deep side-pocket 46,48, with the mid-portions 67 of the straps 64,64' extending outward from each deep side-pocket, said 67 of the straps 64,64' being secured as by sewing to the respective "hook and pile" strips 22,22' which are formed into retaining loops 24, 26. The respective straps 64, 64' thus pass through the retaining loops 24, 26 and are secured, as by stitching, to the "hook and pile" strips 22,22' which form said respective retaining loops 24, 26.

Figure 3:
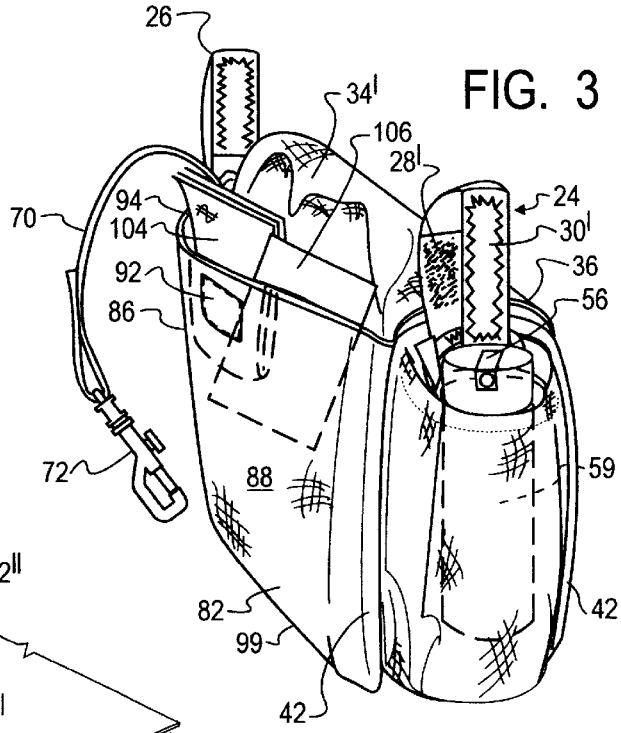
FIG. 3 is a front perspective elevation of the sanitary pet-waste collection pouch embodying the invention illustrated in fully opened condition.

An elongate strap 70 is secured to the interior of at least one deep side-pocket 48 of the deep side-pockets 46, 48 and extends outward of said deep side-pocket 48. The free end of the strap 70 cries a spring-biased key-fob 72 capable of holding the pet owner's keys 74, said key-fob 72 with the keys 74 and the strap 70 (FIGS. 4–6) being capable of storage within the deep side-pocket 48 and are available for easy access by the pet-owner 10. With reference to FIGS. 3 and 7, the rectangular sheets 35' and 35" are placed over and under each side 32', 32" of the sheet 32 and joining said sheet 32 to sheets 35 and 35' in leak proof seam 42 thus defining finished cover flap 82. The sheet 32 defines the effective common outer front and rear walls 34,36 and the cover flap 82, and particularly, with sheets 35 and 35', define the interior opening pocket 86 and exterior opening pocket 88 carried by the cover flap 82. The free end portions and the longitudinal edges of each of the rectangular sheets 35 and 35" are sewn sealed along the bound edges of the Nylon woven fabric sheet 32 opposite sides of said Nylon woven fabric sheet 32. The interior opening pocket 86 as well as the exterior opening pocket 88 and the cover flap 82 shown in FIGS. 2 and 5 and FIGS. 3 and 4 are sewn sealed along three sides; pocket 86 opening toward the interior of the chamber 44 respectively; and pocket 88 opening toward the cover flap 82 as shown in FIGS. 3 and 4.

Figure 6:
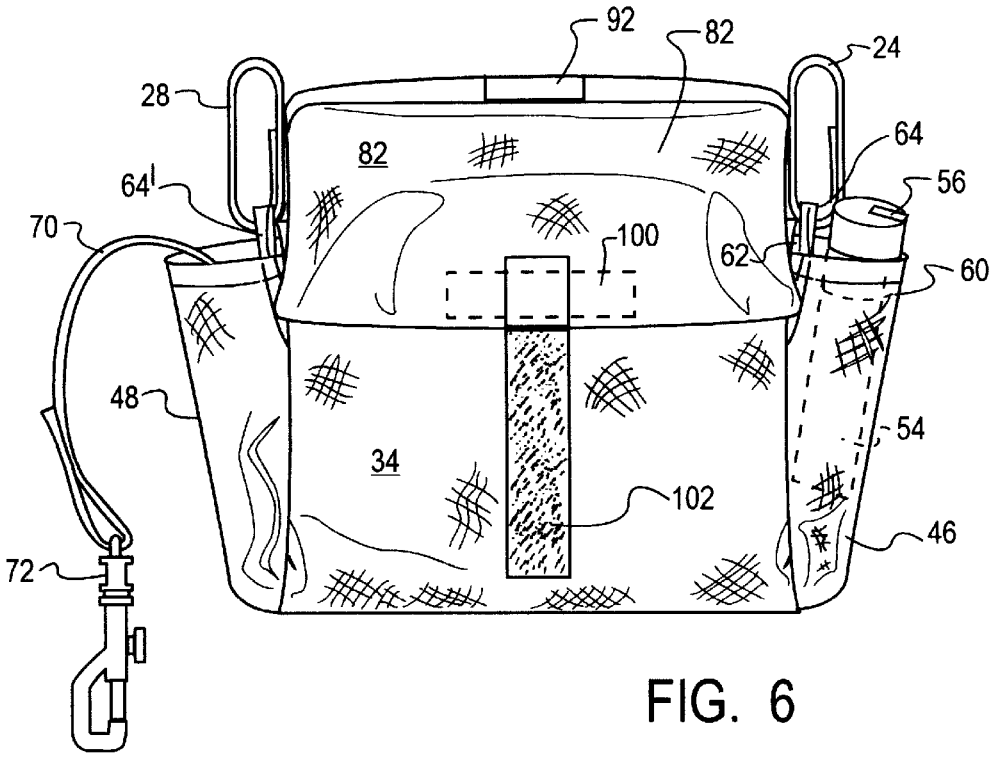
FIG. 6 is a front elevation of the sanitary pet-waste pouch embodying the invention illustrated in closed condition holding plural waste-loaded and tied plastic litter bag; and, FIG. 7 is a diagrammatic fractional representation of the formation of the cover flap and the pockets of the sanitary pet-waste collection pouch carried thereby.

Suitable "hook and pile" closures 90, 92 represented by reference character 92 in FIGS. 2, 4 and 5 and 90 in FIGS. 3 and 6 are secured at said pockets 86,88 adjacent the openings 94 in FIGS. 4 and 5 and 96 in FIGS. 3 and 4 of each of the respective pockets 86, 88 carried by the cover flap 82.

A narrow rectangular "hook" strip 100 of a "hook and pile" closure is secured to the surface of the cover flap 82 at a location closely adjacent but spaced from the closed end 99 of said cover flap 82 and secured oriented horizontally parallel to the closed end 99 and adjacent to the closed end 99 of said cover flap 82.

A narrow rectangular "pile" strip 102 is secured on the front wall 34 oriented lengthwise at an angle (here perpendicularly oriented between and substantially equidistant from the longitudinal edges of the front wall 34, said "pile" strip 102 being longer than the "hook" strip 100, and extends proximately to a location adjacent the bottom of the pouch 20.

In FIG. 3 the sanitary pet-waste collection pouch 20 is illustrated in closed condition with the front wall portion 34' disposed over the chamber 44 covering same and the cover flap 82 engaged fully upon the front wall 34. The spring biased key fob 72 with keys 74 and the key-fob shown in FIGS. 3, 4 and 6 and the strap 70 are illustrated extending outward from deep side-pocket 48. Both loops 24 and 26 are shown completed in FIGS. 3,4 and 6. The exterior opening pocket 88 of the cover flap 82 is exposed when the sanitary pet-waste collection pouch is in closed condition in FIGS. 3, 4 and 6 that is, with the "hook and pile" closure 92 thereof shown visible in phantom representation in FIG. 6.

In FIG. 3, personal items such as money 105, the pet owner's driver's license 106, etc. are shown as partially within the exterior pocket 88, the portion 34' of the front wall 34 is shown covering the otherwise open top portion of the chamber 44. In FIG. 2, the empty plastic litter bags 112, both folded in groups and individually within the pocket 86 are represented in phantom line. The sanitizer dispensing container 54 is visible as anchored within the deep side-pocket 46 with the flip-open spout 56 above the open top 60 of said deep side-pocket 46.

In FIG. 4, the sanitary pet-waste collection pouch according to the invention, is illustrated as carried by the pet owner with the sanitary pet-waste collection pouch 20 mounted on the belt 25 of the pet owner 18. The belt is shown passing through the retaining loops 24,26. The sanitary pet-waste collection pouch 20 is illustrated in its empty condition without loaded plastic litter bags 110 and showing the empty plastic litter bags 112. The "hook" portions 28' of the strips 22, 22' are represented as engaged with the "pile" portions 30' (not visible) of said strips 22, 22' to form the retaining loops 24 and 26 respectively. The "hook" strip 100 is represented in phantom line as positioned on the surface of cover flap 82 adjacent the closed end thereof. The "pile" strip 102 is illustrated in phantom line representation as applied to the surface of the front wall 34 of the pouch 20. In FIG. 2, the respective strips 22,22' are shown in the process of being self-engaged to define the retaining loops 24,26, one loop 26 of which is cover flap 82 after unfastening the "and pile" closure 90. The closure 92 is positioned at a location adjacent the opening 94 of said pocket 86. The retrieved empty plastic litter bag 112 then is opened and the waste deposit X is placed in the empty plastic litter bag 112. After the owner recovers the waste deposit X from the ground, introduces the waste deposit X therein and ties off the loaded plastic litter bag 110 with a tie member 114 to seal same, the tied-off waste loaded litter bag 110 is deposited into the chamber 44 of the pet-waste collection pouch 20. The pet-owner 10 accesses the container 54, flips open the cover 56 and uses the hand-sanitizing composition contained therein to clean his or her hands. The sanitary pet-waste pouch 20 is closed by flipping the cover flap 82 over the open chamber 44 and engaging horizontally oriented "hook" strip 100 with the "pile" strip 102 covering the chamber 44 and thereby closing the sanitary pet-waste collection pouch 20.

Note that the sanitary pet-waste collection pouch 20 can be closed adjustably with the "hook" strip 100 engaging the "pile" strip 102 at any selected location along its length, the larger the number of tied, loaded plastic litter bags 110 held by the chamber 44, the greater the girth of the chamber 44 and vice versa, the smaller the number of tied, loaded plastic litter bags 110, the lesser the girth of the loaded chamber, and hence, the pouch 20. The location of the engagement of said "hook" strip 100 and "pile" strip 102 depends upon the girth of the chamber 44.

In FIG. 6, there is illustrated the sanitary pet-waste collection pouch 20 in closed condition, with the "hook" strip 100 engaged with the "pile" strip 102 at the upper end of said "pile" strip 102 since the chamber 44 is filled with a large number of pet-waste loaded tied plastic litter bags 110. The stitching represents the "hook and pile" closure 90 closing off the pocket 88. In the event of a reduced girth of the chamber 44 of the sanitary pet-waste collection pouch 20, due to a reduced number of waste-loaded tied plastic bags 110 within the chamber 44, the cover flap 82 would extend further over the exterior surface of the front wall 34. In contrast with the filled pouch 20 illustrated in FIG. 6, the sanitary pet-waste collection pouch 20 shown in FIG. 4 is illustrated as closed, relatively flat, with the chamber 44 nearly empty.

Since the hand-sanitizer fluid container 54 is seated upright within the one deep side-pocket 46, and is tethered by elastic band 58, sewn on the inside wall of deep side-pocket 46, the hand-sanitizer container is easily accessible. With the hand-sanitizer composition and with the flip open dispensing spout 56 disposed above the upper end 60 of the deep side-pocket 46, the container 54 and spout 56 are quickly and easily accessed, manipulated and used to apply hand-sanitizing composition quickly to the hands of the pet-owner 10 after use of the sanitary pet-waste collection pouch 20 and completion of the waste deposit X recovery task.

The sanitary waste-collection pouch 20 is capable of storing several tied, sealed waste-loaded plastic litter bags and yet be securely closed by the adjustable closure means, i.e. the "hook" strip and "pile" strip, provided to secure the cover flap in place covering the open portion of the pouch. The length of the "pile" strip 102 is selected so as to enable the cover flap to be secured closed even when the quantity of waste loaded plastic bags 110 is sufficient fully to fill the chamber 44 with loaded and tied litter bags such as to maximize the storing capacity of the chamber 44 of the pouch 20. Securement is made between the "hook" strip 100 and the "pile" strip 102 at any location along the length of said "pile" strip 102.

It should be understood that the size of the sanity pet-waste collection pouch can vary with the size of the pet concerned. Various changes and modifications to the embodiment of the invention described for purposes of illustration may occur to those skilled in the art without departing from the spirit and the scope of the invention as claimed.

What I claim is:

1. A sanitary pet-waste collection pouch comprising an interior open-topped chamber for receiving pet-waste containing plastic litter bags and having opposite sides and a cover flap, said cover flap having exterior opening and interior opening pockets, said interior opening pocket capable of containing and dispensing plural empty plastic litter bags for holding retrieved pet waste, said exterior opening pocket capable of holding personal effects, a pair of upwardly opening deep side-pockets secured along said opposite sides of said pouch, a pair of strap loops secured respectively within each of said deep side-pockets and extending from the opening thereof, a hand-sanitizer dispensing container seated within one of said deep side-pockets, outwardly extending "hook" and "pile" retaining loops secured respectively to each of said strap loops, a "hook and pile" closure within at least one of said exterior opening and said interior opening pockets, said cover flap carrying said exterior opening pocket having a "hook" strip secured to the outer surface thereof and said pouch having a "pile" strip secured thereto oriented in an angular direction relative to said "hook" strip, said "hook" strip being adjustably engagable with said "pile" strip at any location along the length of said "pile" strip for closing and opening said chamber and said pouch.

2. The sanitary pet-waste collection pouch according to claim 1 further comprising at least one elongate strap secured within the other one of said deep side-pockets and having a free end, a key-holding fob being secured to said free end.

3. The sanitary pet-waste collection pouch according to claim 1 further comprising an elastized retaining member secured within said one of said deep side-pockets for maintaining said hand-sanitizer a container therein.

4. The sanitary pet-waste collection pouch according to claim 3 in which said elasticized retainer member is an elasticized band.

5. The sanitary pet-waste collection pouch according to claim 3 in which said elasticized retaining member comprises an elastized band having a mid-portion thereof secured together forming a purchase to enable access to said hand-sanitizer a container.

6. The sanitary pet-waste according to claim 1 and a pet-leash member having a free end, an animal collar adapted to be worn by a pet, said pet leash member being passable through said retaining loops and one of said loops capable of being coupled to said animal collar.

7. The sanitary pet-waste collection pouch according to claim 1 in which said retaining loops enable said pouch to be carried by a belt worn by a pet owner.

8. The sanitary pet-waste collection pouch according to claim 6 wherein said retaining loops are capable of receiving said pet-leash therethrough, said pouch being slidable along said pet-leash enabling said one retainer loop to be coupled to said pet-collar.

9. The sanitary pet-waste collection pouch according to claim 1 in which said pouch is formed of non-absorbant woven fabric having a roughened outer surface and a smooth interior surface serving as the lining of the interior of said pouch.

10. The sanitary pet-waste collection pouch according to claim 1 in which said pouch is formed of a rectangular length of non-absorbant woven fabric, a pair of rectangular sheets of non-absorbant sheet material being secured to the said cover flap to define said exterior and interior pockets.

11. A sanitary pet-waste collection pouch having front and rear walls defining an open-topped interior chamber, a cover flap unitary with said front wall and foldable over said interior chamber covering same, interior opening and exterior opening pockets on opposite sides of said cover flap, "hook and pile" releasable closures secured within said pockets, a pair of open-topped side-pockets along opposite sides of said interior chamber, exterior retaining loops coupled respectively to each of said deep side-pockets and extending outward therefrom, a retaining member secured within said one of said deep side-pockets and extending outward therefrom, a hand-sanitizer dispensing container within one of said deep side-pockets pockets, a retaining member secured within one of said deep-side pockets and engaged with said hand-sanitizer dispensing container, said interior chamber being capable of receiving plural waste-loaded plastic litter bags for temporary storage therein and a "hook and pile adjustable closure being secured to said cover flap and to said rear wall of said pouch, said cover flap capable of overlapping said interior chamber to engage said "hook and pile" adjustable closure closing said chamber and pouch.

12. The sanitary pet-waste collection pouch according to claim 11 in which said flap cover has a closed end of said interior opening pocket and said "hook and pile" adjustable closure comprises a "hook" carrying strip secured to said cover flap at a location along said closed end of said interior opening pocket and a "pile" carrying strip adhered to the rear wall of said pouch and oriented angularly thereon relative to said "hook" carrying strip, said cover flap adapted to overlap said interior chamber to engage said "hook" carrying strip with said "pile" carrying strip at any location therealong dependent upon the girth of said chamber.

13. The sanitary pet-waste collection pouch according to claim 11 wherein said pouch is formed of a length of non-absorbant sheet material folded to define said flap cover, said interior chamber having open sides, said deep side-pockets being secured to the longitudinal edges of said sheet material closing off said otherwise open sides of said interior chamber, and a pair of like non-absorbant sheet members being secured to opposite surfaces of said flap cover defining said interior and exterior opening pockets.

14. The sanitary pet-waste collection pouch according to claim 13 in which said non-absorbant sheet material has a smooth surface and an opposite roughened surface, the smooth surface forming the interior of said pouch and facilitating cleaning of the interior of said pouch.

15. The sanitary pet-waste collection pouch according to claim 11 in which said retaining loops each are formed of a "hook and pile" strip having opposite surfaces, one surface carrying the "hook" portion of said strip and the opposite surface carrying the "pile" portion of said strip, said "hook" and "pile" portions being engagable to define each said retaining loop.

16. The sanitary pet-waste collection pouch according to claim 11 in which said retaining member comprises an elasticized band having opposite ends, said opposite ends being secured within the interior of said one deep side pocket, said elasticized band having a mid-portion folded and fastened together to form a purchase end enabling a user to grasp and pull said elasticized band enabling the user to access said hand-sanitizer composition carried by said hand-sanitizer container.

17. The sanitary pet-waste collection pouch according to claim 11 in which one of said exterior opening and said interior opening pockets are capable of receiving plural empty plastic litter bags for dispensing same and the other one of said exterior opening and said interior opening pockets are capable of receiving personal effects of the user of said pouch.

18. The sanitary pet-waste collection pouch according to claim 11 further comprising an elongate strap secured within the other of said deep side-pockets and having a free end, said free end being coupled to a key-carrying fob capable of being seated within said other of said deep side-pockets along with elongate personal effects belonging to a user of said pouch.

19. The sanitary pet-waste collection pouch according to claim 11 and a pair of elongate straps each having opposite ends, said opposite ends of said straps passing through said retaining loops and being secured respectively within each of said deep side-pockets, each of said retaining loops being formed of a "hook and pile" strip having opposite surfaces, one of said surfaces carrying a "hook" portion of said "hook and pile" strip and the other one of said surfaces carrying a "pile" portion of said "hook and pile" strip, said retaining loops being formed by engagement of said "hook" portion and said "pile" portion of said "hook and pile" strip, said elongate straps each being secured to respective ones of said retaining loops subsequent to formation thereof, and said "hook" and "pile" portions of said formed retaining loops being disengagable and reengagable for modifying the size of said retaining loops.

20. A pet-waste collection pouch comprising an interior open-open-topped chamber for receiving pet-waste containing plastic bags and having opposite front wall and a cover flap integral with said front wall, said cover flap having exterior opening and interior opening pockets, said interior opening pocket capable of containing and dispensing plural plastic empty litter bags capable of holding retrieved pet-waste exterior opening pocket capable of holding personal effects, a pair of upwardly opening deep side-pockets secured along opposite sides of said pouch, outwardly extending "hook and pile" retaining loops secured respectively within each of said deep side-pockets, said retaining loops each formed of a strip having opposite surfaces respectively carrying "hook" and "pile" surface portions, said retaining loops being formed by engagement of said "hook" and "pile" surface portions, "hook" and "pile" closure strips within at least one of said interior and exterior opening pockets, said interior opening pocket-carrying cover flap having a closed end and a "hook" portion of a "hook and pile" strip secured to an outer surface of said interior opening pocket-carrying cover flap at a location adjacent said closed end thereof, and said front wall of said pouch having a "pile" portion of a "hook and pile" strip secured to a surface thereof oriented in an angular direction relative said "hook" portion carried by said cover flap, said "hook" portion being capable of engagement adjustably with said "pile" portion at any location along the length of said "pile" portion carried by said front wall whereby to close said chamber and said pouch.

21. The pet-waste collection pouch according to claim 20 and a pair of strap loops each having opposite ends passing through said retaining loops and being secured respectively within said deep side-pockets and extending toward the opening thereof, said strap loops being se secured to said retaining loops subsequent to formation thereof and securing said retaining loops to said deep side-pockets at least proximate the opening thereof.

22. The pet-waste collection pouch according to claim 20 and a hand-sensitizer composition-carrying dispensing container capable of being received within one of said deep side-pockets, an elasticized retaining band secured within said one deep-side pocket and capable of retaining said hand-sensitizer-carrying dispensing container therein, said retaining band having a grasping portion for enabling access to said hand-sensitizer-carrying dispensing container.

* * * * *